US008754728B2

(12) United States Patent
Ito et al.

(10) Patent No.: US 8,754,728 B2
(45) Date of Patent: Jun. 17, 2014

(54) RELAY

(75) Inventors: Shinsuke Ito, Konan (JP); Youichi Hattori, Nagoya (JP); Norihiko Nadanami, Inuyama (JP); Ryuji Inoue, Tajimi (JP); Takeshi Mitsuoka, Kohnan (JP); Takio Kojima, Ichinomiya (JP); Taku Hirano, Komaki (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/882,640

(22) PCT Filed: Oct. 31, 2011

(86) PCT No.: PCT/JP2011/006098

§ 371 (c)(1), (2), (4) Date: Apr. 30, 2013

(87) PCT Pub. No.: WO2012/060089

PCT Pub. Date: May 10, 2012

(65) Prior Publication Data

US 2013/0214882 A1 Aug. 22, 2013

(30) Foreign Application Priority Data

Nov. 1, 2010 (JP) ..... 2010-245522
Jan. 17, 2011 (JP) ..... 2011-006553

(51) Int. Cl.
*H01H 67/02* (2006.01)
*H01H 50/54* (2006.01)

(52) U.S. Cl.
CPC ..... *H01H 50/546* (2013.01)
USPC ..... 335/133; 335/126; 335/131; 335/132; 335/260

(58) Field of Classification Search
CPC ..... H01H 50/546
USPC ..... 335/126, 131, 132, 260, 133
See application file for complete search history.

(56) References Cited

U.S. PATENT DOCUMENTS 5,973,581 A 10/1999 Jacquin et al.
6,700,466 B1 3/2004 Yamamoto et al.

(Continued)

FOREIGN PATENT DOCUMENTS

JP 51-100859 U 8/1976
JP 55-40905 Y2 9/1980

(Continued)

OTHER PUBLICATIONS

International Search Report for PCT/JP2011/006098 dated Jan. 31, 2012.

(Continued)

*Primary Examiner* — Ramon Barrera
(74) *Attorney, Agent, or Firm* — Sughrue Mion, PLLC

(57) ABSTRACT

A relay includes: a pair of fixed terminals, each being arranged to have a fixed contact on a one-end face; a movable contact member arranged to have a pair of movable contacts that are correspondingly opposed to the respective fixed contacts; and a driving structure operated to move the movable contact member. In a moving direction of the movable contact member, a side where the fixed contacts are located is called a first side, and a side where the movable contacts are located is called a second side. The movable contact member includes: a center section located between the pair of movable contacts and located on the second side relative to the movable contacts; and a pair of extended sections located between the center section and the pair of movable contacts and extended in a direction including a component of the moving direction. At least one of the pair of extended sections has a specific relationship of being overlapped at least partly with the one-end face located on same side relative to the center section in vertical projection of the relay onto a predetermined plane perpendicular to the moving direction.

10 Claims, 12 Drawing Sheets

(56) References Cited

U.S. PATENT DOCUMENTS

| | | | | |
|---|---|---|---|---|
| 7,859,373 | B2 | 12/2010 | Yamamoto et al. | |
| 7,948,338 | B2 | 5/2011 | Niimi et al. | |
| 8,179,217 | B2 * | 5/2012 | Kawaguchi et al. | 335/80 |
| 8,188,818 | B2 | 5/2012 | Cho et al. | |
| 2010/0060392 | A1 | 3/2010 | Cho et al. | |
| 2013/0214881 | A1 | 8/2013 | Ito et al. | |
| 2013/0214884 | A1 | 8/2013 | Ito et al. | |

FOREIGN PATENT DOCUMENTS

| | | | |
|---|---|---|---|
| JP | 57-170252 | U | 10/1982 |
| JP | 1-145041 | U | 10/1989 |
| JP | 9-320437 | A | 12/1997 |
| JP | 10-326530 | A | 12/1998 |
| JP | 2001-118451 | A | 4/2001 |
| JP | 2002-42628 | A | 2/2002 |
| JP | 2003-308773 | A | 10/2003 |
| JP | 2004-273413 | A | 9/2004 |
| JP | 2004-288643 | A | 10/2004 |
| JP | 2004-355847 | A | 12/2004 |
| JP | 2006-019148 | A | 1/2006 |
| JP | 2008-226547 | A | 9/2008 |
| JP | 2008-282719 | A | 11/2008 |
| JP | 2010-62140 | A | 3/2010 |
| WO | 2010/061576 | A1 | 6/2010 |

OTHER PUBLICATIONS

International Search Report of PCT/JP2011/006099 dated Jan. 31, 2012.

International Search Report of PCT/JP2011/006096 dated Jan. 31, 2012.

Notice of Allowance and Fee(s) Due dated Aug. 23, 2013 for related U.S. Appl. No. 13/882,684.

Notice of Allowance and Fee(s) Due dated Dec. 10, 2013 for related U.S. Appl. No. 13/882,684.

* cited by examiner

RELAY

CROSS REFERENCE TO RELATED APPLICATIONS

This application is a National Stage of International application No. PCT/JP2011/006098 filed Oct. 31, 2011, claiming priority based on Japanese Patent Application Nos. 2010-245522 filed Nov. 1, 2010 and 2011-006553 dated Jan. 17, 2011, the contents of all of which are incorporated herein by reference in their entirety.

TECHNICAL FIELD

The present invention relates to a relay.

BACKGROUND ART

The known structure of a relay includes a pair of fixed contacts, a movable contact member having a pair of movable contacts, and a movable iron core and a coil driven to move the movable contact member (for example, PTL1).

CITATION LIST

Patent Literatures

PTL1: JP H09-320437A
PTL2: JP 2002-42628A
PTL3: JP 2004-355847A

SUMMARY OF INVENTION

Technical Problem

In the energized state of the coil (i.e., in the ON state of the relay), electromagnetic repulsion may be caused by a magnetic field produced by the electric current flowing in the relay. The electromagnetic repulsion is the Lorentz force that acts on the electric current of a predetermined direction flowing in the movable contact member in a direction of moving the movable contact member away from the fixed contacts.

The electromagnetic repulsion may prevent the contact between the fixed contact and the movable contact from being stably maintained. Especially, in a system including such a relay, when high current (for example, 5000 A or higher) flows in the relay, large electromagnetic repulsion acts on the movable contact member. This may prevent the contact between the fixed contact and the movable contact from being stably maintained in the ON state of the relay. When the movable contact is separated from the fixed contact by the large electromagnetic repulsion caused by the flow of high electric current in the relay, an arc discharge (hereinafter also referred to as "arc") of high current may be generated between the contacts. The high-current arc discharge may damage the relay.

The object of the invention is thus to provided a technique that reduces electromagnetic repulsion in a relay.

The entire contents of the applications JP 2010-245522A and JP 2011-6553A are incorporated herein by reference.

Solution to Problem

In order to solve at least part of the above problems, the invention provides various aspects and embodiments described below.

First Aspect:

A relay, comprising:

a pair of fixed terminals, each being arranged to have a fixed contact on a one-end face;

a movable contact member arranged to have a pair of movable contacts that are correspondingly opposed to the respective fixed contacts; and a driving structure operated to move the movable contact member such that the respective movable contacts come into contact with the opposed fixed contacts, wherein in a moving direction of the movable contact member, a side where the fixed contacts are located is called a first side, and a side where the movable contacts are located is called a second side, wherein the movable contact member includes:

a center section located between the pair of movable contacts in a path of connecting the pair of movable contacts on the movable contact member and located on the second side relative to the movable contacts; and a pair of extended sections located between the center section and the pair of movable contacts in the path and extended in a direction including a component of the moving direction, wherein at least one of the pair of extended sections has a specific relationship of being overlapped at least partly with the one-end face located on same side relative to the center section in vertical projection of the relay onto a predetermined plane perpendicular to the moving direction.

In the relay according to the first aspect, the extended section has the specific relationship of being at least partly overlapped with the one-end face having the fixed contact. The extended section is extended in the direction including the component of the moving direction. This structure advantageously reduces the current density of the orthogonal direction component of the electric current flowing in the periphery of a contact area of the movable contact member. This structure reduces the electromagnetic repulsion, compared with a movable contact member formed in plate-like shape to be extended only in the orthogonal direction or a movable contact member structured to have an extended section that is not overlapped with the one-end face. The details regarding the electromagnetic repulsion will be described later.

Second Aspect:

The relay according to the first aspect, wherein the extended section having the specific relationship is arranged to have the movable contact on a first end face located on the first side, and the first end face of the extended section having the specific relationship is formed in curved shape that is convex toward the first side.

In the relay according to the second aspect, the first end face is formed in curved shape that is convex toward the first side. The first end face of this shape more effectively reduces the current density of the orthogonal direction component of the electric current flowing in the periphery of the contact area, compared with a first end face in planar shape.

Third Aspect:

The relay according to the first aspect, wherein the movable contact member further includes a pair of opposed sections extended respectively from the pair of extended sections in a direction crossing the moving direction and located to respectively face the pair of fixed contacts, wherein each of the pair of opposed sections is arranged to have the movable contact on an opposed surface facing the fixed contact.

The relay according to the third aspect has the opposed sections and thereby increases the volume of the movable contact member in the periphery of the respective contact areas, compared with the structure without the opposed sections. This structure enables quick decrease of the temperature in the periphery of the contact areas of the movable contact member heated by electric arching.

Fourth Aspect:

The relay according to the third aspect, wherein a first surface of the movable contact member located on a side of the fixed contacts has a connection surface that connects the extended section having the specific relationship with the opposed section extended from the extended section having the specific relationship.

In the relay according to the fourth aspect, the movable contact member with the opposed sections has the connection surfaces that connect the respective extended sections with the respective opposed sections. The presence of the connection surface enables reduction of the current density of the orthogonal direction component of the electric current flowing in the periphery of the contact area. The structure of the relay of the fourth aspect thus more effectively reduces the electromagnetic repulsion, compared with the structure without such connection surfaces.

Fifth Aspect:

The relay according to the fourth aspect, wherein at least part of the connection surface is overlapped with the one-end face in vertical projection of the relay onto the predetermined plane.

The relay according to the fifth aspect has the relationship that the connection surface is overlapped with the one-end face. The relay having this relationship more effectively reduces the current density of the orthogonal direction component of the electric current flowing in the periphery of the contact area, compared with the relay having the relationship that the connection surface is not overlapped with the one-end face. The relay of the fifth aspect thus more effectively uses the connection surface to reduce the electromagnetic repulsion.

Sixth aspect:

The relay according to any one of the first aspect to the fifth aspect, wherein the extended section having the specific relationship is extended along the moving direction.

In the relay according to the sixth aspect, the extended section is extended along the moving direction and thereby enables a larger part of the electric current flowing in the periphery of the contact area to flow in the moving direction. This arrangement furthermore reduces the current density of the orthogonal direction component of the electric current flowing in the periphery of the contact area. The relay of the sixth aspect thus enables further reduction of the electromagnetic repulsion.

Seventh Aspect:

The relay according to any one of the first aspect to the fifth aspect, wherein the extended direction of the extended section having the specific relationship is perpendicular to the moving direction and includes a component of a facing direction where the pair of fixed terminals face each other, and the extended section having the specific relationship is arranged to become closer to the movable contact, which is located on opposite side relative to the center section, from the movable contact located on same side relative to the center section to the center section with respect to the extended direction.

In the relay according to the seventh aspect, each of the extended sections is extended in the direction including the component of the facing direction where the pair of fixed terminals face each other and is extended from the side of the movable contact located on the same side relative to the center section toward the side of the movable contact located on the opposite side. This advantageously shortens the length of the movable contact member connecting the pair of movable contacts and thereby reduces the electrical resistance of the movable contact member. The shortened length of the movable contact member results in weight reduction of the movable contact member. This reduces the possibility that the contact between the movable contact and the fixed contact is opened (separated) even when the movable contact member hits against another component part of the relay due to, for example, an external shock.

Eighth Aspect:

The relay according to any one of the first aspect to the seventh aspect, wherein the one-end face located on same side as the extended section having the specific relationship relative to the center section is formed in curved shape that is convex toward the second side.

In the relay according to the eighth aspect, the one-end face having the fixed contact is formed in curved shape that is convex toward the second side. Compared with the one-end face in planar shape, the one-end face of this shape more effectively reduces the current densities of the electric currents that respectively flow in the movable contact member and the fixed terminal and respectively have the components parallel to each other but reverse to each other, in the area close to the contact area where the movable contact is in contact with the fixed contact. This accordingly reduces the possibility that the fixed contact and the movable contact are separated from each other in the ON state of the relay.

Ninth Aspect:

The relay according to any one of the first aspect to the eighth aspect, wherein the movable contact member is formed of a single member.

In the relay according to the ninth aspect, the movable contact member is formed of a single member and thereby the movable contact member is manufactured easily. Therefore, the manufacturing cost of the relay is reduced.

The present invention may be implemented by any of various applications, for example, the relay, a method of manufacturing the relay and a moving body, such as vehicle or ship, equipped with the relay.

DESCRIPTION OF EMBODIMENTS

Embodiments of the invention are described in the following sequence:

A to D: Respective Embodiments

E: Modifications

A. First Embodiment

A-1. General Structure of Relay

Figure 1:
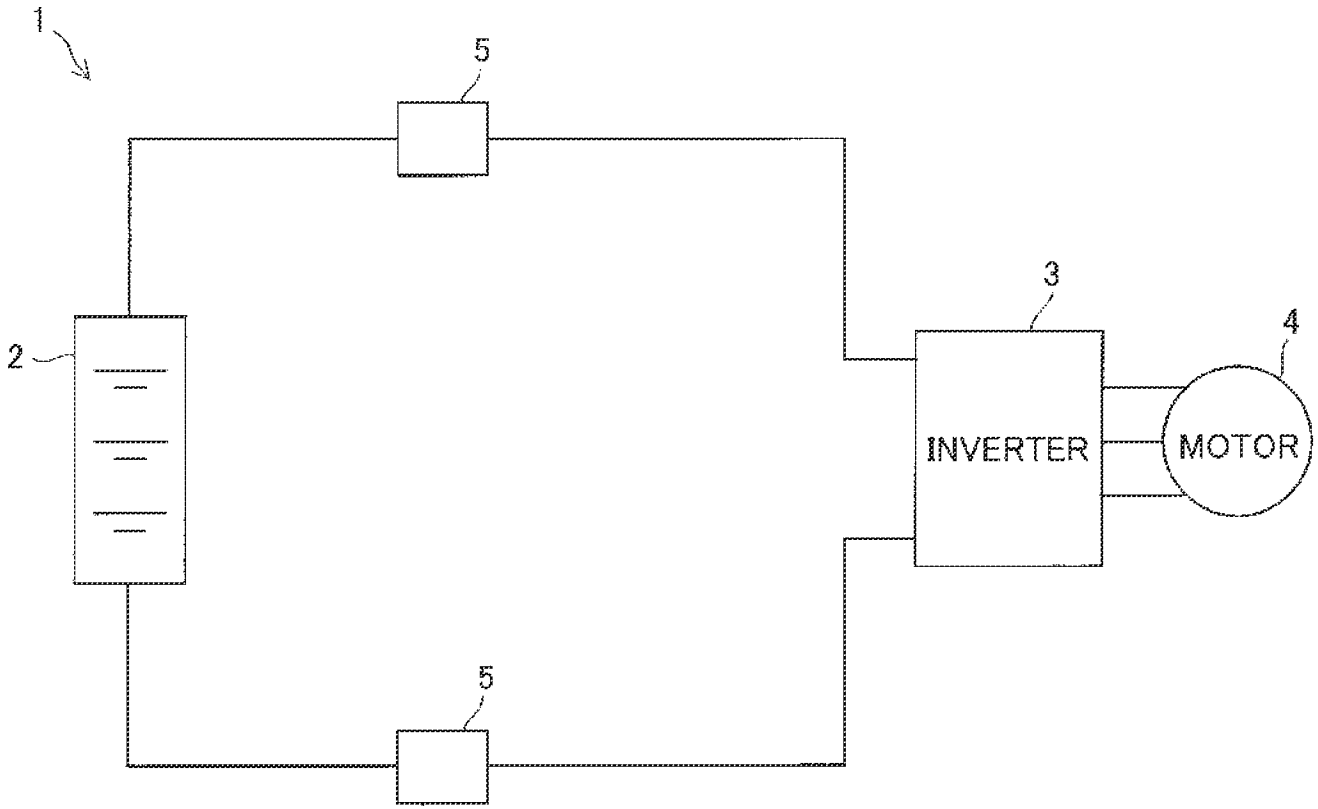
FIG. 1 is a diagram illustrating an electric circuit 1 including a relay 5 according to a first embodiment.

FIG. 1 is a diagram illustrating an electric circuit (system) 1 including a relay 5 according to a first embodiment. The electric circuit 1 is mounted on, for example, a vehicle. The electric circuit 1 includes a DC power source 2, the relay 5, an inverter 3 and a motor 4. The inverter 3 converts the direct current of the DC power source 2 into alternating current. Supplying the alternating current converted by the inverter 3 to the motor 4 drives the motor 4. The driven motor 4 causes the vehicle to run. The relay 5 is located between the DC power source 2 and the inverter 3 to open and close the electric circuit 1. In other words, switching the relay 5 between the ON position and the OFF position opens and closes the electric circuit 1. For example, in the event of an abnormality occurring in the vehicle, the relay 5 works to cut off the electrical connection between the DC power source 2 and the inverter 3.

Figure 2:
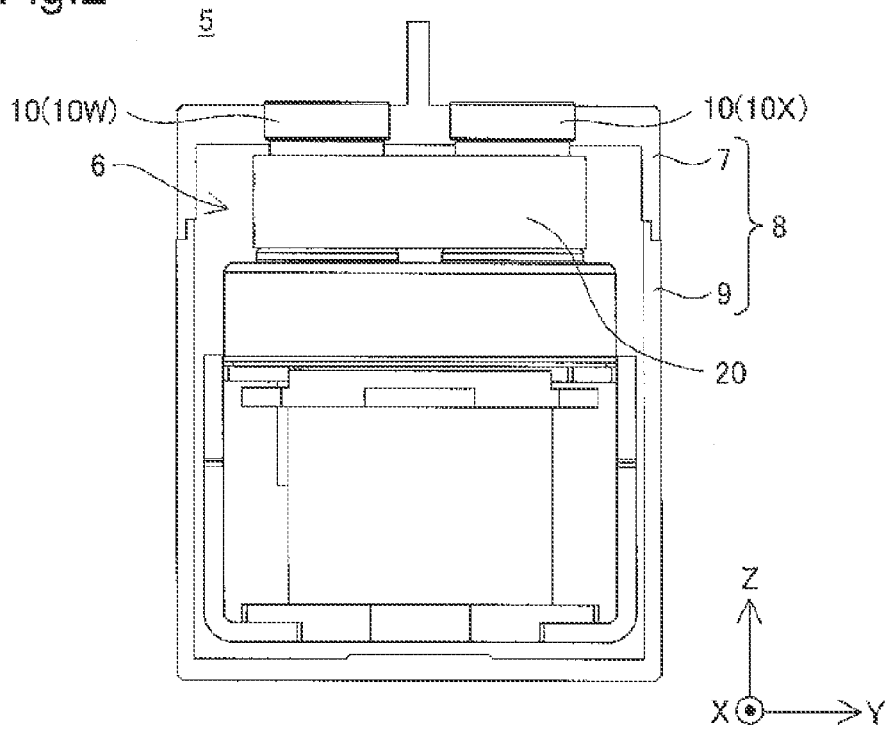
FIG. 2 is a first appearance diagram of the relay 5.
Figure 3:
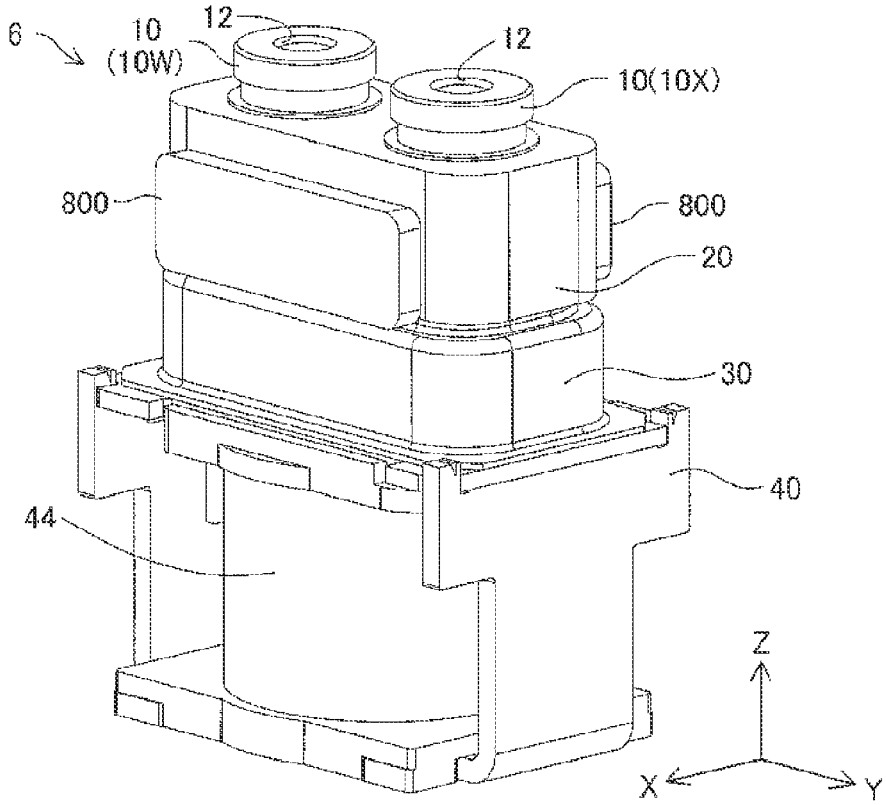
FIG. 3 is a second appearance diagram of the relay 5.
Figure 4:
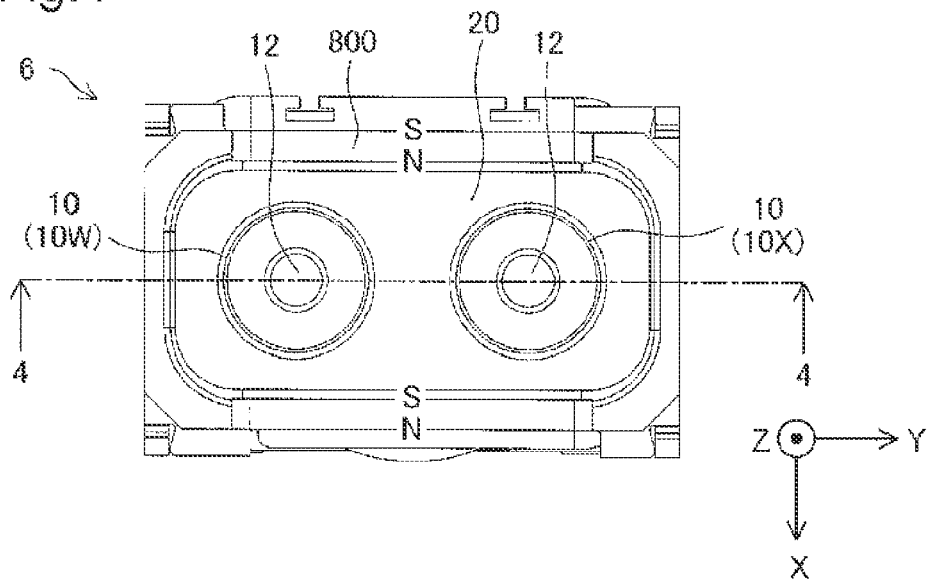
FIG. 4 is a third appearance diagram of the relay 5.

FIG. 2 is a first appearance diagram of the relay 5. FIG. 3 is a second appearance diagram of the relay 5. FIG. 4 is a third appearance diagram of the relay 5. For the better understanding, the internal structure inside an outer casing 8 is shown by the solid line in FIG. 2. The outer casing 8 shown in FIG. 2 is omitted from the illustration of FIGS. 3 and 4. In order to specify the directions, XYZ axes are shown in FIGS. 2 to 4. The XYZ axes are shown in other drawings according to the requirements. According to this embodiment, the relay 5 is placed on a plane parallel to the X axis and the Y axis. In the state that the relay 5 is placed on the plane, the Z-axis direction is the vertical direction (height direction), the positive Z-axis direction is the vertically upward direction, and the negative Z-axis direction is the vertically downward direction. The positive Z-axis direction side is also called upper side (first side), and the negative Z-axis direction side is also called lower side (second side).

As shown in FIG. 2, the relay 5 includes a relay main unit 6 and the outer casing 8 for protecting the relay main unit 6. The relay main unit 6 has two fixed terminals 10. The two fixed terminals 10 are joined with a first vessel 20. As shown in FIG. 3, the fixed terminal 10 has a connection port 12 formed for connection of wiring of the electric circuit 1. As shown in FIG. 2, the outer casing 8 includes an upper case 7 and a lower case 9. The upper case 7 and the lower case 9 internally form a space for the relay main unit 6. The upper case 7 and the lower case 9 are both made of resin material. The outer casing 8 has permanent magnets 800 described later. The magnetic field of the permanent magnets 800 extends an arc by the Lorentz force and thereby accelerates extinction of the arc. According to this embodiment, the permanent magnets 800 are arranged to apply the Lorentz force to a pair of arcs generated inside the relay 5 to separate the pair of arcs from each other.

Figure 5:
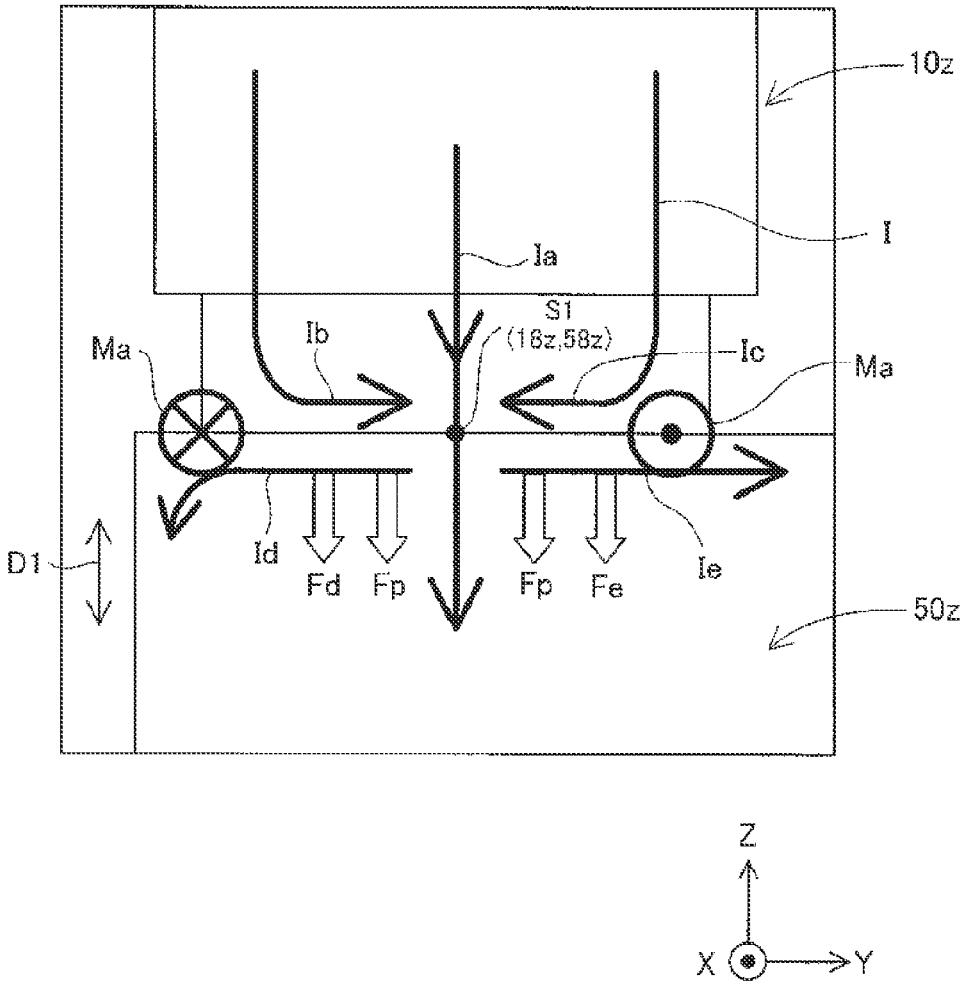
FIG. 5 is a diagram illustrating forces acting on a movable contact member.

A-2. Forces Acting on Movable Contactor Prior to description of the detailed structure of the relay 5, the following describes forces acting on a movable contact member with reference to FIG. 5. FIG. 5 is a diagram illustrating the forces acting on the movable contact member. FIG. 5 is a schematic diagram illustrating the periphery of a contact area S1 where a fixed contact and a movable contact come into contact with each other in a 4-4 cross sectional view of FIG. 4. A movable contact member 50*z* is moved along the Z-axis direction (vertical direction) by a driving structure described later.

In the ON state of the relay, when electric current I flows in the relay, various forces Fe, Fd and Fp act on the movable contact member 50*z*. For example, in the state that the electric current I flows from a fixed terminal 10*z* toward the movable contact member 50*z*, electric current Ia passing through the contact area S1 and flowing in the moving direction of the movable contact member 50*z* (vertical direction, Z-axis direction) generates a magnetic field Ma in a predetermined rotation direction about the electric current Ia as the axis in an area close to the contact area S1. The predetermined rotation direction is counterclockwise direction when the drawing of FIG. 5 is viewed from the negative Z-axis direction side. In other words, in the plane shown in FIG. 5, the direction of the magnetic field Ma in a right-side area of the electric current Ia is the direction from the negative X-axis direction side to the positive X-axis direction side. In the plane shown in FIG. 5, the direction of the magnetic field Ma in a left-side area of the electric current Ia is, on the other hand, the direction from the positive X-axis direction side to the negative X-axis direction side.

The magnetic field generated by the electric current Ia applies the Lorentz forces Fd and Fe to electric currents Id and Ie having direction components perpendicular to a moving direction D1 of the movable contact member 50*z* ("horizontal direction" components) in the electric current flowing in the movable contact member 50*z*, in the direction of moving the movable contact member away from a fixed contact 18*z* (negative Z-axis direction, downward direction). In the state that electric current flows from the movable contact member 50*z* toward the fixed terminal 10*z*, the downward Lorentz forces Fe and Fd are similarly applied to electric currents having horizontal direction components in the electric current flowing in the movable contact member 50*z*.

With respect to electric currents that are parallel to each other and have reverse direction components in the electric current flowing in the periphery of the contact area S1, a magnetic field generated by one of the electric currents applies the Lorentz force to the other electric current in the direction of separating from one electric current. For example, with respect to electric currents Ib and Id that are parallel to each other but have reverse direction components, a magnetic field generated by the electric current Ib applies the Lorentz force Fp to the electric current Id in the direction of moving the movable contact member 50*z* away from the fixed contact 18*z* (negative Z-axis direction, downward direction). With respect to electric currents Ic and Ie, the downward Lorentz force Fp is similarly applied to the electric current Ie. In the state that electric current flows from the movable contact member 50*z* toward the fixed terminal 10*z*, the downward Lorentz force Fp is similarly applied to electric current having a horizontal direction component in the electric current flowing in the movable contact member 50*z*.

As described above, when electric current flows in the relay in the state that the fixed contact 18*z* and a movable contact 58*z* are in contact with each other, the forces Fd, Fe and Fp are applied to the movable contact member 50*z* in the direction of moving the movable contact member 50*z* away from the fixed contact 18*z*. These forces Fd, Fe and Fp are collectively called "electromagnetic repulsion".

A-3.Detailed Structure of Relay

Figure 6:
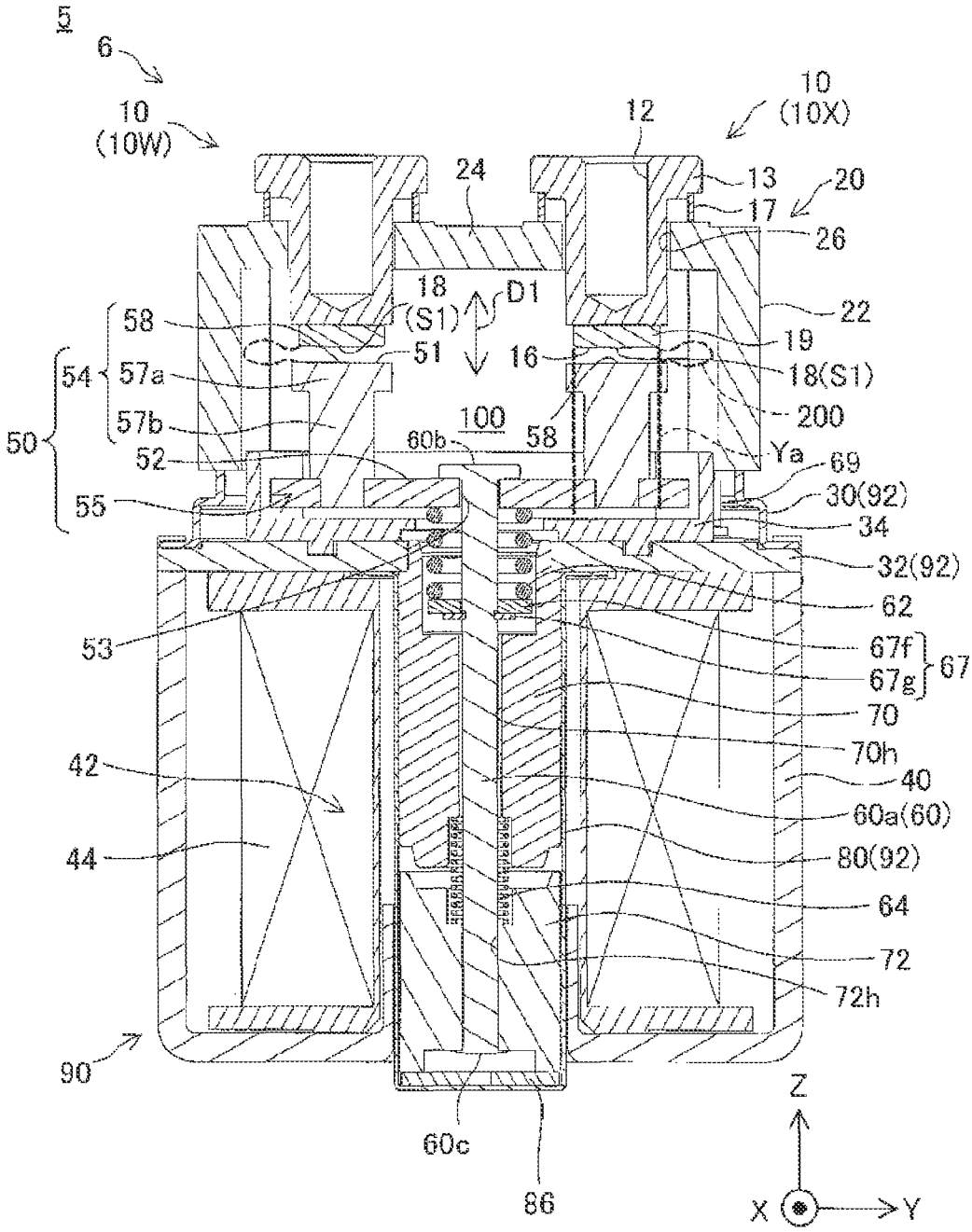
FIG. 6 is a 4-4 cross sectional view of a relay main unit 6 according to the embodiment.
Figure 7:
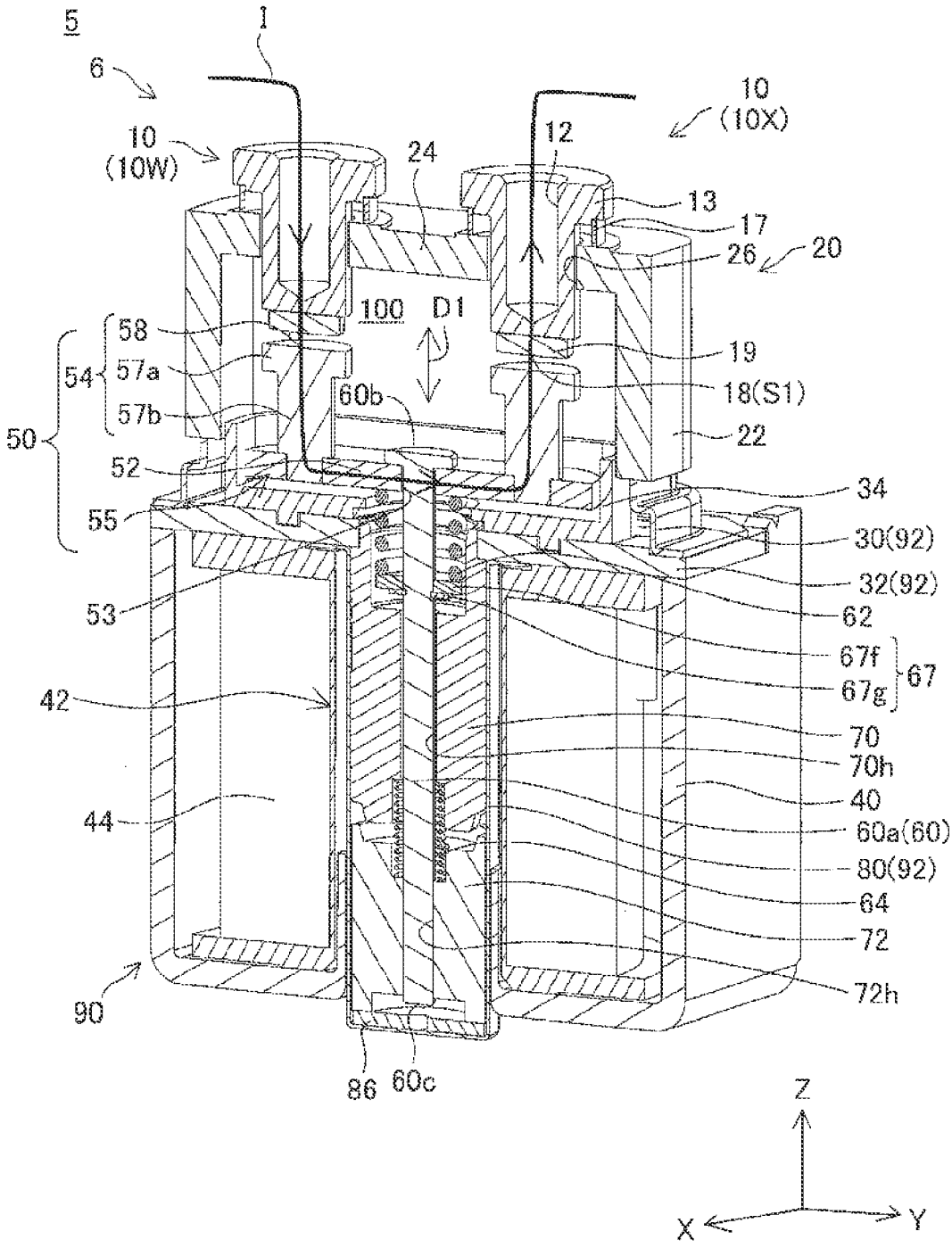
FIG. 7 is a perspective view of the relay main unit 6 shown in FIG. 6.

FIG. 6 is a 4-4 cross sectional view of the relay main unit 6 according to the embodiment. FIG. 7 is a perspective view of the relay main unit 6 shown in FIG. 6. As shown in FIGS. 6 and 7, the relay main unit 6 includes a pair of fixed terminals 10, a movable contact member 50 and a driving structure 90. The relay main unit 6 also includes a first vessel 20 and a second vessel 92. The first vessel 20 and the second vessel 92 form an air-tight space 100 inside the relay main unit 6. During supply of electric current from the DC power source 2 to the motor 4, one of the pair of fixed terminals 10 which the electric current flows in is called positive fixed terminal 10W, and the other which the electric current flows out is called negative fixed terminal 10X. The following describes the relay 5 during supply of electric current from the DC power source 2 to the motor 4. Electric current I flowing in the relay 5 in the contact state that the pair of fixed terminals 10 are in contact with the movable contact member 50 is conceptually shown in FIG. 7.

The fixed terminals 10 are members having electrical conductivity. The fixed terminals 10 are made of, for example, a copper-containing metal material. The fixed terminal 10 has a bottom and is formed in cylindrical shape. The fixed terminal 10 has a terminal contact area 19 on the bottom located at one end (negative Z-axis direction side). The terminal contact area 19 may be made of the copper-containing metal material like the other parts of the fixed terminal 10 or may be made of a material having higher heat resistance (for example, tungsten) to protect from damage caused by an arc 200. A one-end face 16 formed by the terminal contact area 19 of the fixed terminal 10 is opposed to a movable contact 58 of the movable contact member 50. The one-end face 16 is in circular shape in vertical projection to a predetermined plane (horizontal plane according to this embodiment) perpendicular to the moving direction D1 of the movable contact member 50. The one-end face 16 has a fixed contact 18 that comes into contact with the moving contactor 50. The fixed terminal 10 has a flange 13 formed on the other end (positive Z-axis direction side) to be extended outward in the radial direction. Part of each fixed terminal 10 is inserted through the first vessel 20, such that the fixed contact 18 is placed inside the air-tight space 100 and the flange 13 is placed outside the air-tight space 100.

The first vessel 20 is a member having insulating properties. The first vessel 20 is made of a ceramic material, for example, alumina or zirconia and has excellent heat resistance. According to this embodiment, the first vessel 20 is made of alumina. The first vessel 20 has a side face member 22 forming the side face and a bottom 24, from which part of each fixed terminal 10 is protruded. The first vessel 20 also has an opening formed one end thereof opposed to the bottom 24 (i.e., side where the second vessel 92 is located). The bottom 24 has two through holes 26 formed to allow insertion of the two fixed terminals 10.

The flange 13 of each fixed terminal 10 is air-tightly joined with the outer surface (surface exposed on the outside) of the bottom 24 of the first vessel 20. More specifically, the fixed terminal 10 is joined with the first vessel 20 by the following structure. One side face of the outer surface of the flange 13 opposed to the bottom 24 of the first vessel 20 has a diaphragm 17 formed to protect the joint between the fixed terminal 10 and the first vessel 20 from damage. The diaphragm 17 is formed to relieve the stress generated at the joint due to the thermal expansion difference between the fixed terminal 10 and the first vessel 20 made of different materials. The diaphragm 17 is formed in cylindrical shape having the larger inner diameter than those of the through holes 26. The diaphragm 17 is made of, for example, an alloy like kovar and is bonded to the outer surface of the bottom 24 of the first vessel 20 by brazing. For example, silver solder may be used for brazing. When the diaphragm 17 is provided as a separate body from the fixed terminal 10, the diaphragm 17 is brazed to the flange 13 of the fixed terminal 10. Alternatively the diaphragm 17 may be formed integrally with the fixed terminal 10.

The second vessel 92 includes an iron core case 80 that has a bottom and is formed in cylindrical shape, a rectangular base 32 and a joint member 30 in approximately rectangular parallelepiped shape.

The joint member 30 is made of, for example, a metal material of low thermal expansion coefficient that is relatively similar to the thermal expansion coefficient of the first vessel 20. The joint member 30 may be a magnetic body (for example, 42-alloy or kovar) or a non-magnetic body (for example, Ni-28Mo-2Fe). According to this embodiment, the joint member 30 is a magnetic body. The joint member 30 is air-tightly joined with both the first vessel 20 and the base 32. The joint member 30 and the first vessel 20 are joined with each other by, for example, brazing. The joint member 30 and the base 32 are joined with each other by, for example, laser welding, resistance welding or electron beam welding. The joint member 30 may be formed of a single member or may be formed as a combination of a plurality of members having different properties.

The base 32 is a magnetic body and is made of a metal magnetic material, for example, iron or stainless steel 430. The base 32 has a through hole formed near its center to allow insertion of a fixed iron core 70 described later.

The iron core case 80 is a non-magnetic body. The iron core case 80 has an open upper end opposed to its bottom end. The iron core case 80 is air-tightly joined with the base 32 by, for example, laser welding.

The air-tight joint of the respective members 10, 20, 30, 32 and 80 as described above form the air-tight space 100 that is placed inside the relay 5. Hydrogen or a hydrogen-based gas is confined in the air-tight space 100 at or above the atmospheric pressure (for example, at 2 atm), in order to prevent heat generation of the fixed contact 18 and the movable contact 58 by the generation of the arc 200. More specifically, after the joint of the respective members 10, 20, 30, 32 and 80, the air-tight space 100 is vacuumed via a vent pipe 69 arranged to communicate the inside with the outside of the air-tight space 100 shown in FIG. 6. After such vacuuming, the gas like hydrogen is confined to a predetermined pressure via the vent pipe 69 in the air-tight space 100. After the gas like hydrogen is confined at the predetermined pressure, the vent pipe 69 is caulked to prevent leakage of the gas like hydrogen from the air-tight space 100.

The movable contact member 50 is placed inside the air-tight space 100. The movable contact member 50 is moved to come into contact with and separate from the respective fixed contacts 18 (contact and separation) by the function of the driving structure 90. More specifically, the movable contact member 50 moves in the direction that the movable contacts 58 face the fixed contacts 18 (vertical direction, Z-axis direction). The movable contact member 50 comes into contact with the pair of fixed terminals 10 to electrically connect the pair of fixed terminals 10 with each other. The movable contact member 50 is arranged to face the two fixed terminals 10.

The movable contact member 50 is a member having electrical conductivity and is made of, for example, a copper-containing metal material.

The movable contact member 50 has a first member 55 and a pair of second members 54. The first member 55 is formed in horizontal plate-like shape. The second members 54 are formed in bar-like shape. According to this embodiment, the second members 54 correspond to the "extended sections" described in "Solution to Problem".

The first member 55 is located below (on the second side of) the movable contacts 58 of the second members 54. The second members 54 are provided corresponding to the pair of fixed terminals 10.

The first member 55 has a center section 52 located between the pair of movable contacts 58 in the path (shortest path) of connecting the pair of movable contacts 58 with each other on the movable contact member 50. The center section 52 is also located between the pair of movable contacts 58 with respect to the facing direction (Y-axis direction) that is perpendicular to the moving direction D1 and where the fixed terminals 10 face each other. The center section 52 is located below (on the second side of) the pair of movable contacts 58. The center section 52 is a part located on the center of the first member 55. A component part of the driving structure 90 described later is inserted through the center section 52. More specifically, a rod 60 is inserted through a through hole 53 formed in the center section 52. The above path also works as the path of electric current flowing in the movable contact member 50.

The second members 54 are fixed to the first member 55. The second members 54 are extended from the first member 55 toward the corresponding fixed contacts 18. The second member 54 has a length in the moving direction D1 that is equal to or greater than the thickness of the first member 55. The second member 54 has an approximately circular cross section perpendicular to the moving direction Dl. According to this embodiment, the second members 54 are extended along the moving direction D1 of the movable contact member 50. An upper end face 51 (also called "first end face 51") of each second member 54 is opposed to the one-end face 16. The first end face 51 has the movable contact 58 that comes into contact with the fixed contact 18. In other words, the respective second members 54 are located between the center section 52 and the respective movable contacts 58 in the path of the movable contact member 50 that connects the pair of movable contacts 58. The second member 54 has an end face portion 57*a* on its upper side, which includes the first end face 51 and is formed to have any diameter. It is, however, preferable that the diameter of the end face portion 57*a* is greater than the diameter of a remaining portion 57*b* directly fixed to the first member 55. This structure increases the volume of the end face portion 57*a*, compared with the structure that the diameter of the end face portion 57*a* is equal to the diameter of the remaining portion 57*b*. Even when the temperature of the end face portion 57*a* rises during continuous power supply or due to generation of an arc 200 in the course of opening or closing the contacts 18 and 58, this accelerates diffusion of heat from the end face portion 57*a* and thereby quickly lowers the temperature of the end face portion 57*a*.

When the outer edge of the one-end face 16 is virtually moved along the moving direction D1, at least part of the second member 54 is located inside the outer edge of the one-end face 16 that is positioned on the same side relative to the center section 52 with respect to the Y-axis direction. According to this embodiment, at least part of the second member 54 over the range from the first end face 51 to the center section 52 is located inside the outer edge of the one-end face 16. For the better understanding, a contour Ya by virtually moving the outer edge of the one-end face 16 in the moving direction D1 is shown by the dotted lines in FIG. 6.

Figure 8:
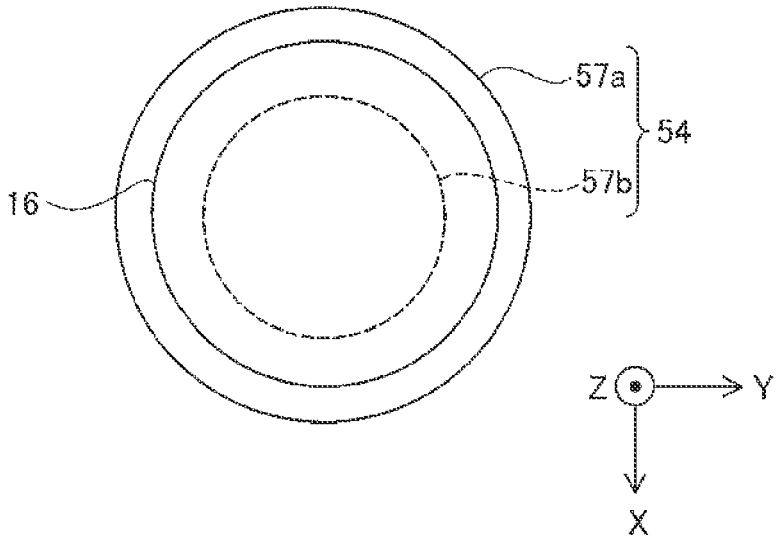
FIG. 8 is a diagram illustrating the relationship between a one-end face 16 and a second member 54.

Prior to description of the other component parts of the relay 5, the following describes the relationship between the one-end face 16 and the second member 54 from another viewpoint with reference to FIG. 8. FIG. 8 is a diagram illustrating the relationship between the one-end face 16 and the second member 54. More specifically, FIG. 8 shows the one-end face 16 and the second member 54 in vertical projection of the relay 5 to a predetermined plane perpendicular to the moving direction D1. As shown in FIG. 8, in vertical projection of the relay 5, the second member 54 is at least partly overlapped with the one-end face 16 that is positioned on the same side relative to the center section 52. According to this embodiment, the remaining portion 57*b* of the extended section 54 is located inside the contour of the one-end face 16.

The following describes the other component parts of the relay 5 with referring back to FIGS. 6 and 7. The relay 5 further includes a third vessel 34. The third vessel 34 is placed inside the air-tight space 100. The third vessel 34 is in concave shape and is placed on the base 32. The third vessel 34 is made of an insulating body of, for example, a synthetic resin material or a ceramic material. The third vessel 34 is arranged to prevent an arc 200 generated, for example, between the fixed contact 18 and the movable contact 58 from coming into contact with an electrically conductive member (for example, the joint member 30 as described later). The third vessel 34 is also arranged to prevent the arc 200 from coming into contact with the joint part of the component parts. The presence of the third vessel 34 accordingly reduces the possibility that the relay 5 is damaged by the generation of the arc 200. The presence of the third vessel 34 also effectively prevents rotation of the movable contact member 50.

The driving structure 90 includes a rod 60, a base 32, a fixed iron core 70, a movable iron core 72, an iron core case 80, a coil 44, a coil bobbin 42, a coil case 40, a first spring 62 as an elastic member and a second spring 64 as another elastic member. In order to bring the respective movable contacts 58 into contact with the corresponding fixed contacts 18, the driving structure 90 moves the movable contact member 50 in the direction that the movable contacts 58 face the fixed contacts 18 (vertical direction, Z-axis direction). More specifically, the driving structure 90 moves the movable contact member 50 to bring the respective movable contacts 58 into contact with the corresponding fixed contacts 18 or to separate the respective movable contacts 58 from the corresponding fixed contacts 18. The coil 44 is wound on the resin coil bobbin 42 in hollow cylindrical shape.

The coil case 40 is a magnetic body and is made of a metal magnetic material, for example, iron. The coil case 40 is formed in concave shape. More specifically, the coil case 40 has a bottom section and a pair of side face sections extended from the bottom section in the vertical direction (moving direction D1). The coil case 40 also has a through hole formed to place the iron core case 80 inside. The coil case 40 surrounds the coil 44 to allow passage of magnetic flux. The coil case 40, in combination with the base 32, the fixed iron core 70 and the movable iron core 72, forms a magnetic circuit as described below.

A rubber element 86 is placed on a bottom of the iron core case 80 having the bottom and being formed in cylindrical shape to relieve the shock applied by the movable iron core 72 to the relay 5. The iron core case 80 is arranged to pass through a through hole formed inside of the coil bobbin 42.

The fixed iron core 70 is formed in substantially columnar shape. The fixed iron core 70 has a through hole 70*h* formed along from the upper end to the lower end. The fixed iron core 70 is mostly placed inside the iron core case 80.

The movable iron core 72 is formed in substantially columnar shape. The movable iron core 72 has a through hole 72*h* formed along from the upper end to the lower end. When the coil 44 is energized, the movable iron core 72 is attracted to the fixed iron core 70 and moves upward.

The rod 60 is a non-magnetic body. The rod 60 includes a columnar shaft member 60*a*, an arc-shaped one-end portion 60*c* provided at one end of the shaft member 60*a* and an other-end portion 60*b* provided at the other end of the shaft member 60*a*. The one-end portion 60*c* is fixed to the movable iron core 72. The other-end portion 60*b* is arranged on the other side across the center section 52 from the side with the one-end portion 60*c*. The other-end portion 60*b* restricts the movement of the movable contact member 50 toward the fixed terminals 10 by the second spring 64 in the state that the driving structure 90 is not operated (in the non-energized state of the coil 44). The one-end portion 60*c* is used to move the rod 60 in conjunction with the movement of the movable iron core 72 in the state that the driving structure 90 is operated.

The shaft member 60*a* has a mounting member 67 arranged to position the first spring 62. The mounting member 67 includes a C ring 67*g* fixed to the shaft member 60*a* and a base element 67*f* placed on the C ring 67*g*.

The first spring 62 is a coil spring. The first spring 62 has one end that is in contact with the base element 67*f* and the other end that is in contact with the movable contact member 50. The first spring 62 presses the movable contact member 50 in a direction that moves the respective movable contacts 58 closer to the corresponding fixed contacts 18 (positive Z-axis direction, upward direction).

The second spring 64 is a coil spring. The second spring 64 has one end that is in contact with the movable iron core 72 and the other end that is in contact with the fixed iron core 70. The second spring 64 presses the movable iron core 72 in a direction that moves the movable iron core 72 away from the fixed iron core 70 (negative Z-axis direction, downward direction).

The following describes the operations of the relay 5. When the coil 44 is energized, the movable iron core 72 is attracted to the fixed iron core 70. The movable iron core 72 accordingly moves closer to the fixed iron core 70 against the pressing force of the second spring 64 to be in contact with the fixed iron core 70. As the movable iron core 72 moves upward, the rod 60 and the movable contact member 50 also move upward. This causes the respective movable contacts 58 to come into contact with the corresponding fixed contacts 18. The first spring 62 presses the movable contact member 50 toward the fixed contacts 18 in the contact state of the movable contacts 58 with the fixed contacts 18, thereby maintaining the stable contact between the fixed contacts 18 and the movable contacts 58.

When power supply to the coil 44 is cut off, on the other hand, the movable iron core 72 moves downward to be away from the fixed iron core 70 mainly by the pressing force of the second spring 64. The movable contact member 50 is then pressed by the other-end portion 60*b* of the rod 60 to move downward (direction away from the fixed contacts 18). The respective movable contacts 58 are accordingly separated from the corresponding fixed contacts 18, so as to cut off the electrical continuity between the two fixed terminals 10.

As shown in FIG. 6, the arcs 200 generated in the course of opening or closing the fixed contacts 18 and the movable contacts 58 are extended outward of the air-tight space 100 by the magnetic field formed by the permanent magnets 800 (FIG. 4). More specifically, the pair of arcs 200 are extended to be separated from each other by the permanent magnets 800.

As described above, in the relay 5 of the first embodiment, the movable contact member 50 has the second members 54 extended in the direction including the component of the moving direction D1 (FIG. 6). The second members 54 located between the respective movable contacts 58 and the center section 52 are at least partly overlapped with the corresponding one-end faces 16 in vertical projection of the relay 5 onto a predetermined plane perpendicular to the moving direction D1 (FIG. 8). In the ON state of the relay 5, this positional relationship causes part of the electric current flowing in the periphery of the contact area S1 where the movable contact 58 of the movable contact member 50 is in contact with the fixed contact 18 to flow in the moving direction D1. In other words, this positional relationship advantageously reduces the current density of the orthogonal direction component of the electric current flowing in the periphery of the contact area 51 (movable contact 58) of the movable contact member 50. This reduces the electromagnetic repulsions Fe and Fd (FIG. 5), compared with the movable contact member 50 formed in plate-like shape to be extended only in the orthogonal direction or the movable contact member 50 structured to have the second members 54 that are not overlapped with the corresponding one-end faces 16.

The second member 54 includes the first end face 51 having the movable contact 58 on the first side (upper side). Since the second member 54 forms the movable contact 58, a large part of the electric current flowing in the periphery of the contact area 51 is made to flow in the moving direction D1. This further reduces the current density of the orthogonal direction component of the electric current flowing in the periphery of the contact area S1 of the movable contact member 50. This results in further reduction of the electromagnetic repulsions Fe and Fd (FIG. 5).

According to this embodiment, the second members 54 are extended along the moving direction D1. This structure causes a greater part of the electric current flowing in the periphery of the contact area S1 to flow in the moving direction D1. This furthermore reduces the current density of the orthogonal direction component of the electric current flowing in the periphery of the contact area S1, thus more effectively reducing the electromagnetic repulsions Fe and Fd (FIG. 5).

B. Second Embodiment

Figure 9:
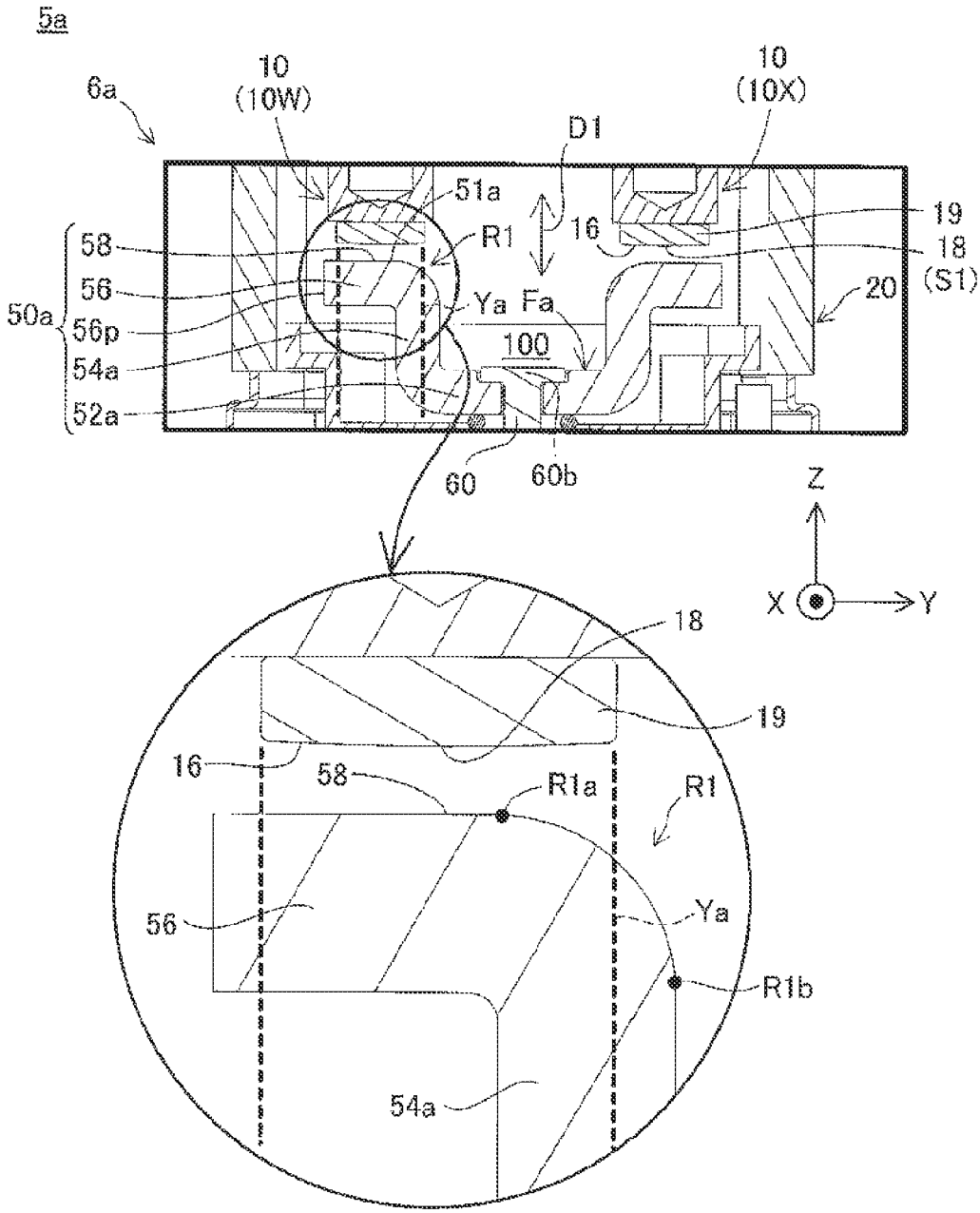
FIG. 9 is a diagram illustrating a relay 5*a* according to a second embodiment.

FIG. 9 is a diagram illustrating a relay 5*a* according to a second embodiment. FIG. 9 is a cross sectional view equivalent to the 4-4 cross section of FIG. 4. FIG. 9 illustrates the periphery of a movable contact member 50*a* placed inside a relay main unit 6*a*. FIG. 9 also includes an enlarged illustration of the encircled part. The difference between the relay 5*a* of the second embodiment and the relay 5 of the first embodiment is the structure of the movable contact member 50*a*. The other structure (for example, the driving structure 90) is similar to that of the relay 5 of the first embodiment. The like parts are expressed by the like numerals or symbols and are not specifically described here.

The movable contact member 50*a* is formed of a single member. For example, the movable contact member 50*a* is formed by pressing a single metal plate. The movable contact member 50*a* includes a center section 52*a*, a pair of extended sections 54*a* and a pair of opposed sections 56. The opposed section 56 is arranged to face the fixed contact 18 that is positioned on the same side relative to the center section 52*a*. The opposed section 56 has a movable contact 58 formed on an opposed surface 51*a* facing the fixed contact 18. In the movable contact member 50 formed by pressing a single metal plate, the surface condition of the opposed surface 51*a* is better than the end face of the extended section 54*a*. The movable contact 58 can thus be formed by a less number of steps. The "single member" herein includes a member structured to have separate components placed on the opposed sections 56 of the movable contact member 50*a* to form the movable contacts 58. For example, the separate components may be made of a material having higher heat resistance than that of the other part (for example, extended sections 54*a*) of the movable contact member 50*a*.

The center section 52*a* is located below the pair of movable contacts 58. The center section 52*a* is located between the pair of movable contacts 58 in the path of connecting the pair of movable contacts 58 on the movable contactor 50*a*. The center section 52*a* is also located between the pair of movable contacts 58 with respect to the facing direction (Y-axis direction). The rod 60 as the component part of the driving structure 90 is inserted through the center section 52*a*.

The extended sections 54*a* are extended from the center section 52*a* upward (toward the fixed contacts 18) along the moving direction D1.

The respective opposed sections 56 are extended from the respective extended sections 54*a*. The respective opposed sections 56 are extended in the direction crossing the moving direction Dl. More specifically, the opposed sections 56 are extended in the direction perpendicular to the moving direction D1 and along the facing direction (Y-axis direction) where the pair of fixed terminals 10 face each other. The opposed sections 56 are extended from the respective extended sections 54*a* outward of the air-tight space 100. The opposed section 56 has an end face (edge surface) 56*p* that is not opposed to the one-end face 16 but faces the direction perpendicular to the moving direction D1. More specifically, the end face 56*p* of the opposed section 56 faces the facing direction (Y-axis direction).

Like the first embodiment, when the outer edge of the one-end face 16 is virtually moved along the moving direction D1, at least part of the extended section 54*a* is located inside the outer edge of the one-end face 16 that is positioned on the same side relative to the center section 52*a*. According to this embodiment, at least part of the extended section 54*a* over the range from the opposed section 56 to the center section 52*a* is located inside the outer edge of the one-end face 16. For the better understanding, a contour Ya by virtually moving the outer edge of the one-end face 16 along the moving direction D1 is shown by the dotted lines in FIG. 9.

A first surface Fa of the movable contact member 50*a* that is located on the fixed contact 18-side (upper side) has a curved surface R1 that connects the extended section 54*a* with the opposed section 56 extended from the extended section 54*a*. According to this embodiment, the curved surface R1 is in arc shape. For the better understanding, part of the curved surface R1 that is connected with the opposed section 56 is called one-end portion R1*a*, and part that is connected with the extended section 54*a* is called other-end portion R1*b* (enlarged illustration). At least part of the curved surface R1 is located inside the contour Ya. In other words, the curved surface R1 is at least partly overlapped with the one-end face 16 in vertical projection of the relay 5*a* onto a plane perpendicular to the moving direction D1. The curved surface R1 of this embodiment corresponds to the "connection surface" described in Solution to Problem.

Figure 10:
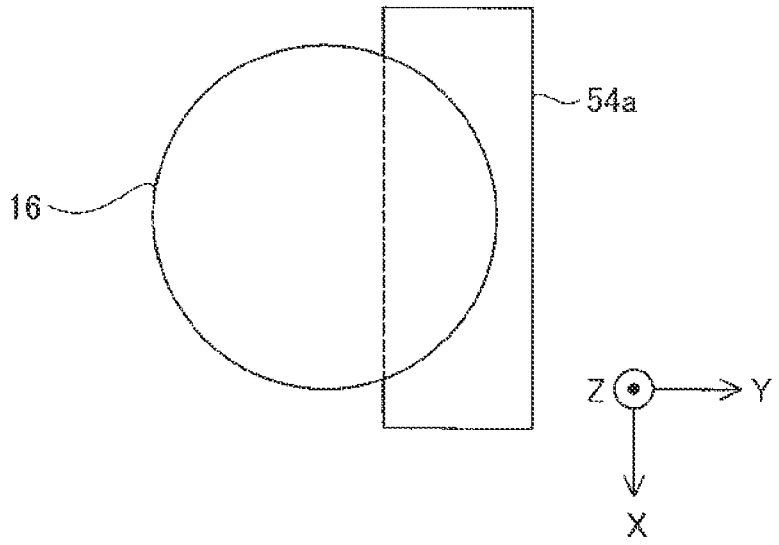
FIG. 10 illustrates the one-end face 16 and an extended section 54*a* in vertical projection.
Figure 11:
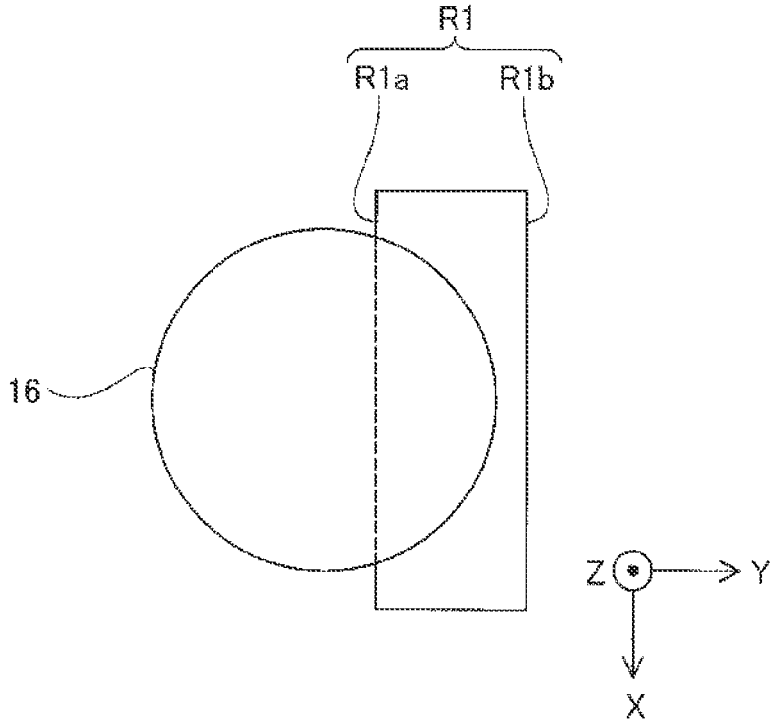
FIG. 11 illustrates the one-end face 16 and a curved surface R1 in vertical projection.

The following describes the relationship between the one-end face 16 and the movable contact member 50*a* from another viewpoint with reference to FIGS. 10 and 11. FIG. 10 illustrates the one-end face 16 and the extended section 54*a* in vertical projection of the relay 5*a* onto a predetermined plane perpendicular to the moving direction D1. FIG. 11 illustrates the one-end face 16 and the curved surface R1 in vertical projection of the relay 5*a* onto a predetermined plane perpendicular to the moving direction D1.

As shown in FIG. 10, in vertical projection of the relay 5*a*, the extended section 54*a* is at least partly overlapped with the one-end face 16 that is positioned on the same side relative to the center section 52*a*. As shown in FIG. 11, in vertical projection of the relay 5*a*, the curved surface R1 is at least partly overlapped with the one-end face 16 that is positioned on the same side relative to the center section 52*a*. It is preferable that at least part of the curved surface R1 including a one-end portion R1*a* is overlapped with the one-end face 16.

As described above, the relay 5*a* of the second embodiment has the opposed sections 56 that are extended from the extended sections 54*a* in the direction crossing the moving direction D1 (FIG. 9). The opposed sections 56 respectively have the movable contacts 58 (FIG. 9). This structure increases the volume of the movable contact member 50*a* in the periphery of the contact areas S1 where the movable contacts 58 are respectively in contact with the corresponding fixed contacts 18, compared with the structure without the opposed sections 56. This enables quick decrease of the temperature in the periphery of the contact areas S1 of the movable contact member 50*a* heated by the arcs generated between the contacts 18 and 58.

The movable contact member 50*a* has the curved surfaces R1 to connect the opposed sections 56 with the extended sections 54*a* (FIG. 9). This structure enables a greater part of the electric current flowing in the periphery of the movable contacts 58 to flow in the moving direction D1, compared with the structure without any connection surface at the connection of the opposed section 56 with the extended section 54*a*. In the structure with the extended sections 54*a*, the presence of the connection surface enables reduction of the current density of the orthogonal direction component of the electric current flowing in the periphery of the contact area Si where the movable contact 58 is in contact with the fixed contact 18. This accordingly reduces the electromagnetic repulsions Fe and Fd (FIG. 5), compared with the structure without any connection surface. Specifically the positional relationship of this embodiment that at least part of the curved surface R1 including the one-end portion R1*a* is overlapped with the one-end face 16 enables a greater part of the electric current flowing in the periphery of the movable contact 58 to flow in the moving direction D1. This relationship further reduces the current density of the orthogonal direction component of the electric current flowing in the periphery of the contact area S1.

Additionally, the relay 5*a* of the second embodiment has the positional relationship that part of the curved surface R1 is overlapped with the one-end face 16 in vertical projection of the relay 5*a* onto a predetermined plane perpendicular to the moving direction. This positional relationship enables a greater part of the electric current flowing in the periphery of the contact area S1 (movable contact 58) of the movable contact member 50*a* to flow in the moving direction D1. This further reduces the current density of the orthogonal direction component of the electric current flowing in the periphery of the contact area S1. This results in further reduction of the electromagnetic repulsions Fe and Fd (FIG. 5).

Like the relay 5 of the first embodiment described above, the relay 5*a* of the second embodiment has the positional relationship that part of the extended section 54*a* extended in the moving direction D1 is overlapped with the one-end face 16 in vertical projection of the relay 5*a* onto a predetermined plane perpendicular to the moving direction D1 (FIG. 10). Like the first embodiment, this positional relationship reduces the current density of the orthogonal direction component of the electric current flowing in the periphery of the contact area S1 (movable contact 58) of the movable contact member 50*a*. The relay 5*a* of the second embodiment can thus reduce the electromagnetic repulsions Fe and Fd (FIG. 5) by the presence of the extended sections 54*a*, like the relay 5 of the first embodiment.

The movable contact member 50*a* is formed from a single member. This facilitates production of the movable contact member 50*a* and thereby reduces the manufacturing cost of the relay 5*a*.

C. Third Embodiment

Figure 12:
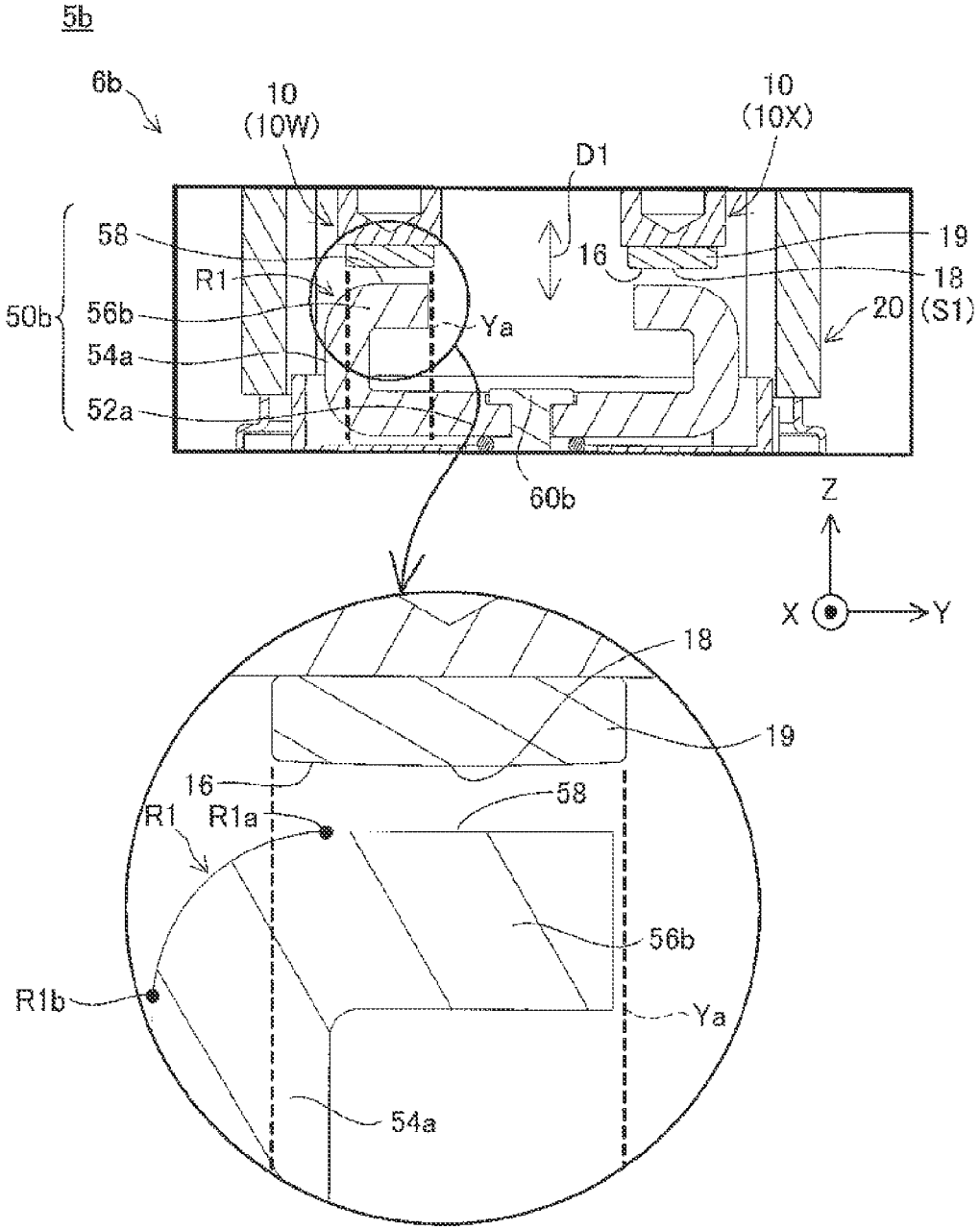
FIG. 12 is a diagram illustrating a relay 5*b* according to a third embodiment.

FIG. 12 is a diagram illustrating a relay 5*b* according to a third embodiment. FIG. 12 is a cross sectional view equivalent to the 4-4 cross section of FIG. 4. Like FIG. 9, FIG. 12 illustrates the periphery of a movable contact member 50*b* placed inside a relay main unit 6*b*. FIG. 12 also includes an enlarged illustration of the encircled part. The difference between the relay 5*b* of the third embodiment and the relay 5*a* of the second embodiment is the extended direction of opposed sections 56*b* of a movable contact member 50*b* . The other structure (for example, the driving structure 90) is similar to that of the relay 5*a* of the second embodiment. The like parts are expressed by the like numerals or symbols and are not specifically described here.

The pair of opposed sections 56*b* are extended from the extended sections 54*a* in the direction closer to each other. The relay 5*b* of the third embodiment has the positional relationship between the curved surface R1 and the one-end face 16 and the positional relationship between the extended section 54*a* and the one-end face 16 similar to those of the relay 5*a* of the second embodiment.

The relay 5*b* of the third embodiment has the similar advantageous effects to those of the second embodiment described above. For example, the movable contact member 50*b* has the curved surface R1 connecting the opposed section 56*b* with the extended section 54*a* (FIG. 12). This structure enables a large part of the electric current flowing in the periphery of the movable contact 58 to flow in the moving direction D1, compared with the structure without any connection surface at the connection of the opposed section 56*b* with the extended section 54*a*.

D. Fourth Embodiment

Figure 13:
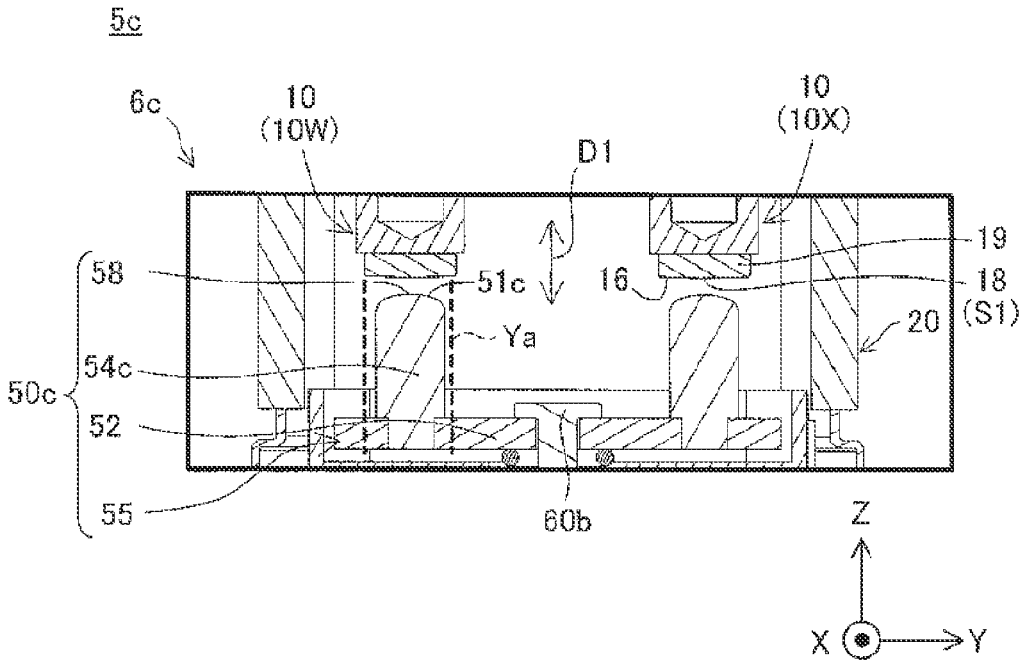
FIG. 13 is a diagram illustrating a relay 5*c* according to a fourth embodiment.

FIG. 13 is a diagram illustrating a relay 5*c* according to a fourth embodiment. FIG. 13 is a cross sectional view equivalent to the 4-4 cross section of FIG. 4. FIG. 13 illustrates the periphery of a movable contact member 50*c* placed inside a relay main unit 6*c*. The differences between the relay 5*c* of the fourth embodiment and the relay 5 of the first embodiment (FIG. 6) are the shape of a first end face 51*c* of a second member 54*c* and its peripheral shape. The other structure (for example, the driving structure 90) is similar to that of the relay 5 of the first embodiment. The like parts are expressed by the like numerals or symbols and are not specifically described here.

The second members 54*c* provided as extended sections are extended along the moving direction D1, like the second members 54 of the first embodiment. The second member 54*c* has no end face portion 57*a* of the larger diameter than the other portions (FIG. 6). A first end face 51*c* of the second member 54*c* opposed to the one-end face 16 is in curved shape that is convex toward the first side (upward). The first end face 51*c* has a movable contact 58 formed on the top thereof. The relationship between the second member 54*c* and the one-end face 16 is similar to that of the relay 5 of the first embodiment. For example, in vertical projection of the relay 5*c* onto a predetermined plane perpendicular to the moving direction D1, the second member 54*c* is at least partly overlapped with the one-end face 16. According to this embodiment, the second member 54*c* is fully overlapped with the one-end face 16.

As described above, the relay 5*c* of the fourth embodiment has the first end face 51*c* formed in curved shape that is convex toward the first side. The first end face 51*c* of this shape enables a larger part of the electric current flowing in the periphery of the contact area S1 (movable contact 58) to flow in the moving direction D1, compared with the first end face 51*c* of planar shape. This further reduces the current density of the orthogonal direction component (horizontal direction component), which is orthogonal to the moving direction D1, of the electric current flowing in the periphery of the contact area S1 (movable contact 58) of the movable contact member 50*c*. This results in further reduction of the electromagnetic repulsions Fe and Fd (FIG. 5).

E. Modifications

Among various components described in the above embodiments, the components other than those described in independent claims are additional and may be omitted according to the requirements. The invention is not limited to the above embodiments or examples, but a multiplicity of variations and modifications may be made to the embodiments without departing from the scope of the invention. Some examples of possible modifications are given below.

E-1. First Modification

The extended sections 54, 54*a* or 54*c* are extended along the moving direction D1 according to the above embodiments, but may be extended in any direction including the component of the moving direction D1. In other words, the movable contact member 50, 50*a*, 50*b* or 50*c* may be formed in arbitrary bent shape to have the pair of movable contacts 58 and the center section 52 or 52*a* located between the pair of movable contacts 58 and arranged at a different position from the position of the pair of movable contacts 58 with respect to the moving direction D1 (Z-axis direction, height direction). More specifically, the relay 5, 5*a*, 5*b* or 5*c* may have any structure as long as the first surface Fa of the movable contact member 50, 50*a*, 50*b* or 50*c* located on the fixed contact 18-side has a portion having the component of the moving direction D1 in the shortest path on the movable contact member 50, 50*a*, 50*b* or 50*c* that connects the pair of movable contacts 58. The first surface F1 of the extended section 54, 54*a* or 54*c* is thus required to have the component of the moving direction Dl. The movable contact member 50, 50*a*, 50*b* or 50*c* may have any structure as long as at least part of the connecting section (extended section 54, 54*a* or 54*c*) connecting the center section 52 or 52*a* with the movable contact 58 has the following relationship to the one-end face 16. In vertical projection of the relay 5, 5*a*, 5*b* or 5*c* onto a predetermined plane perpendicular to the moving direction D1, at least part of the connecting section should be overlapped with the one-end face 16. This positional relationship advantageously reduces the current density of the orthogonal direction component of the electric current flowing in the periphery of the contact area S1 (movable contact 58) of the movable contact member 50, 50*a*, 50*b* or 50*c* in the ON state of the relay 5, 5*a*, 5*b* or 5*c*. The following describes concrete examples.

Figure 14:
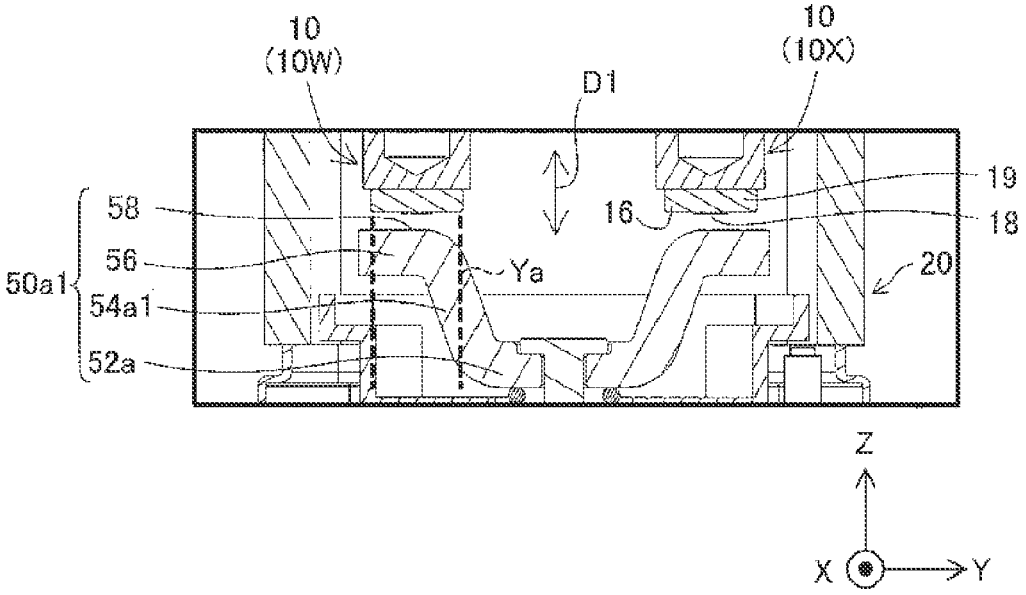
FIG. 14 is a diagram illustrating a first variation of a first modification.

FIG. 14 is a diagram illustrating a first variation of the first modification. A movable contact member 50*a*1 of the first variation has the structure partly modified from the structure of the movable contact member 50*a* of the second embodiment (FIG. 9). As shown in FIG. 14, extended sections 54*a*1 may be extended obliquely from the center section 52*a* toward the opposed sections 56. The extended sections 54*a*1 of the first modification are extended linearly. More specifically, the extended section 54*a*1 is extended in a direction having the component of the facing direction (Y-axis direction) that is perpendicular to the moving direction D1 and where the pair of fixed terminals 10 face each other, in addition to the component of the moving direction D1.

Figure 15:
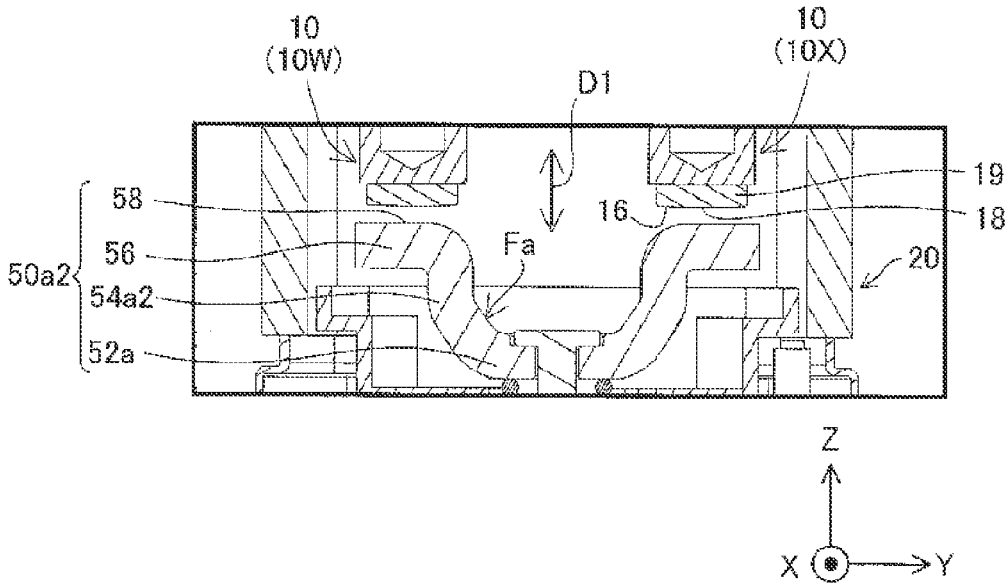
FIG. 15 is a diagram illustrating a second variation of the first modification.

FIG. 15 is a diagram illustrating a second variation of the first modification. A movable contact member 50*a*2 of the second variation has the structure partly modified from the structure of the movable contact member 50*a* of the second embodiment. As shown in FIG. 15, extended sections 54*a*2 may be extended obliquely from the center section 52*a* toward the opposed sections 56. The extended sections 54*a*2 of the second modification are in bent shape.

As described above, according to the first variation or the second variation, the extended sections 54*a*1 or 54*a*2 are extended in the direction including the component of the facing direction (Y-axis direction). The extended section 54*a*1 or 54*a*2 is arranged to become closer to the movable contact 58 located on the opposite side relative to the center section 52*a* along the line from the movable contact 58 located on the same side relative to the center section 52*a* toward the center section 52*a*. This arrangement shortens the length of the movable contact member 50*a*1 or 50*a*2 that connects the pair of movable contacts 58. The shortened length reduces the electrical resistance of the movable contact member 50*a*1 or 50*a*2 and thereby prevents voltage drop in the relay during supply of electric power. The shortened length also reduces the weight of the movable contact member 50*a*1 or 50*a*2. This reduces the possibility that the contact between the movable contact 58 and the fixed contact 18 is opened (separated) by, for example, an external shock. In the movable contact member 50*a*1 of the first variation or the movable contact member 50*a*2 of the second variation, the pair of extended sections 54*a*1 or 54*a*2 are inclined to the moving direction D1 to be closer to each other toward the center section 52*a*. This arrangement further reduces the length of the movable contact member 50*a*1 or 50*a*2 connecting the pair of movable contacts 58.

E-2. Second Modification

Figure 16:
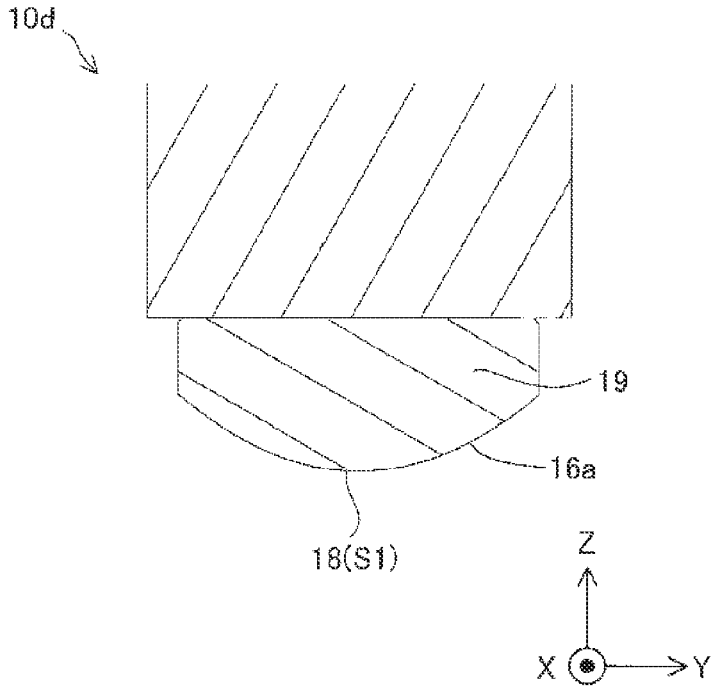
FIG. 16 is a diagram illustrating a second modification.

FIG. 16 is a diagram illustrating a second modification. FIG. 16 illustrates a fixed terminal 10*d* of the second modification. As shown in FIG. 16, a one-end face 16*a* having a fixed terminal 18 may be formed in curved shape that is convex downward (toward the second side). The one-end face 16*a* of this shape effectively reduces the current densities of the electric currents that respectively flow in the movable contact member and the fixed terminal 10 and respectively have the components parallel to each other but reverse to each other (Y-axis direction components), in the area close to the contact area 51 where the movable contact 58 is in contact with the fixed contact 18. This results in reduction of the electromagnetic repulsion Fp (FIG. 5). This further reduces the possibility that the fixed contact 18 and the movable contact 58 are separated from each other in the ON state of the relay.

E-3. Third Modification

The mechanism of moving the movable iron core 72 by magnetic force is adopted for the driving structure 90 according to the above embodiment, but this is not restrictive. Any other mechanism may be used to move the movable contact member. For example, a lifting mechanism that is externally operable to be expanded and contracted may be placed on the other side face of the center section 52 of the movable contact member 50 (FIG. 6) that is opposite to the side of the fixed terminals 10. The movable contact member 50 may be moved by expansion or contraction of the lifting mechanism. The structure of the first spring 62 is also not limited to the structure of the above embodiment but may be the structure of no displacement accompanied with the movement of the rod 60 or any other suitable structure.

E-4. Fourth Modification

According to the above embodiment, the pair of extended sections 54, 54*a* or 54*c* are both extended in the direction including the component of the moving direction D1 and overlapped at least partly with the respective one-end faces 16 in vertical projection onto a predetermined plane. The requirement is, however, that either one of the pair of extended sections 54, 54*a* or 54*c* has the relationship of being at least partly overlapped with the corresponding one-end face 16 in vertical projection of the relay 5, 5*a*, 5*b* or 5*c* onto a predetermined plane perpendicular to the moving direction D1 (also called "first relationship"). This modified arrangement still reduces the current density of the orthogonal direction component of the electric current flowing in the periphery of the contact area S1 on the side of the extended section having the first relationship. This structure reduces the electromagnetic repulsions Fe and Fd, compared with the structure that neither of the pair of extended sections has the first relationship.

E-5. Fifth Modification

Figure 17:
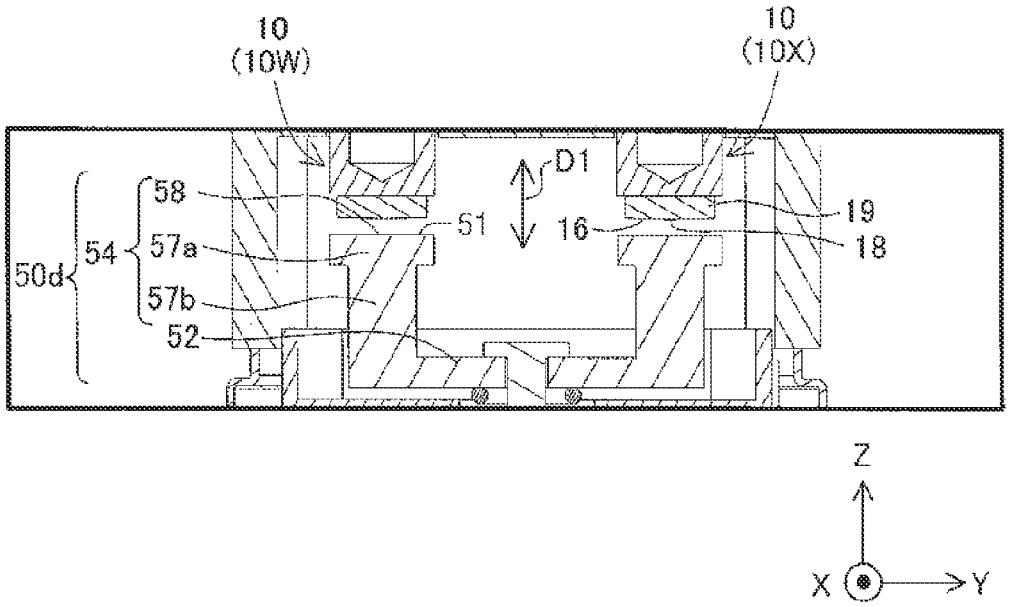
FIG. 17 is a diagram illustrating a movable contact member 50*d*.

FIG. 17 is a diagram illustrating a movable contact member 50*d*. The movable contact member 50*d* is formed from a single member, unlike the movable contact member 50 of the first embodiment (FIG. 6). According to the first and the fourth embodiments described above, the movable contact member 50 or 50*c* is formed from a plurality of different members. The movable contact member 50*d* may, however, be formed from a single member as shown in FIG. 17. This facilitates production of the movable contact member 50*d* and reduces the manufacturing cost of the relay, like the second and the third embodiments.

E-6. Sixth Modification The connection surface at the connection of the extended section 54*a* with the opposed section 56 or 56*b* is the curved surface R1 (FIG. 8 and FIG. 12) according to the second and the third embodiments, but the shape of the connection surface is not limited to the curved surface. For example, the connection surface may be inclined to be located on the lower side (second side) from the opposed section 56 or 56*b* to the extended section 54*a*. In another example, the connection surface may be a plane (inclined surface) of connecting the extended section 54*a* with the opposed section 56 or 56*b*. The inclined surface is inclined to the direction perpendicular to the moving direction D1 (horizontal direction). Any of these modified structures enables a larger part of the electric current flowing in the periphery of the movable contact 58 to flow in the moving direction D1, compared with the structure without any connection surface at the connection of the opposed section 56 or 56*b* with the extended section 54*a*. Like the second and the third embodiments, any of these modified structures thus reduces the current density of the orthogonal direction component of the electric current flowing in the periphery of the contact area 51 where the movable contact 58 is in contact with the fixed contact 18. Like the second and the third embodiments, it is preferable that at least part of the connection surface including the one-end portion R1*a* that is connected with the opposed section 56 or 56*b* is at least partly overlapped with the one-end face 16 in vertical projection of the relay onto a predetermined plane perpendicular to the moving direction D1. Like the second and the third embodiments, any of these modified structures thus more effectively reduces the current density of the orthogonal direction component of the electric current flowing in the periphery of the contact area S1.

Reference Signs List

5 to 5*c*: Relay
6 to 6*c*: Relay main unit
10, 10*d*, 10*z*: Fixed terminal
16, 16*a*: One-end face
18, 18*z*: Fixed contact
20: First vessel
50 to 50*c*, 50*z*, 50*a*1, 50*a*2: Movable contact member
51: First end face
51*a*: Opposed surface
51*c*: First end face
52, 52*a*: Center section
54: Second member (extended section)
54*a*: Extended section
54*c*: Second member (extended section)
54*a*1: Extended section
55: First member
56 to 56*b*: Opposed section
57*a*: End face portion
57*b*: Remaining portion
58, 58*z*: Movable contact
90: Driving structure
92: Second vessel
R1: Curved surface
S1: Contact area
D1: Moving direction
Fa: First surface
Fd, Fe, Fp: Lorentz force (electromagnetic repulsion)

The invention claimed is:

1. A relay, comprising:

a pair of fixed terminals, each being arranged to have a fixed contact on a one-end face;

a movable contact member arranged to have a pair of movable contacts that are correspondingly opposed to the respective fixed contacts; and a driving structure operated to move the movable contact member such that the respective movable contacts come into contact with the opposed fixed contacts, the relay further comprising:

a first vessel arranged to allow insertion of the pair of fixed terminals;

a second vessel joined with the first vessel; and an air-tight space formed by at least the pair of fixed terminals, the first vessel and the second vessel to allow the movable contact member and the respective fixed contacts to be placed therein, wherein in a moving direction of the movable contact member, a side where the fixed contacts are located is called a first side, and a side where the movable contacts are located is called a second side, wherein the movable contact member includes:

a center section located between the pair of movable contacts in a path of connecting the pair of movable contacts on the movable contact member and located on the second side relative to the movable contacts; and a pair of extended sections located between the center section and the pair of movable contacts in the path and extended in a direction including a component of the moving direction, wherein at least one of the pair of extended sections has a specific relationship of being overlapped at least partly with the one-end face located on same side relative to the center section in vertical projection of the relay onto a predetermined plane perpendicular to the moving direction, wherein each of the pair of extended sections has a projecting part which protrudes to the first side relative to the center section, and wherein the projecting part has a length in the moving direction that is equal to or greater than a thickness of the center section.

2. The relay according to claim 1, wherein the extended section having the specific relationship is arranged to have the movable contact on a first end face located on the first side, and the first end face of the extended section having the specific relationship is formed in curved shape that is convex toward the first side.

3. The relay according to claim 1, wherein the movable contact member further includes a pair of opposed sections extended respectively from the pair of extended sections in a direction crossing the moving direction and located to respectively face the pair of fixed contacts, wherein each of the pair of opposed sections is arranged to have the movable contact on an opposed surface facing the fixed contact.

4. The relay according to claim 3, wherein a first surface of the movable contact member located on a side of the fixed contacts has a connection surface that connects the extended section having the specific relationship with the opposed section extended from the extended section having the specific relationship.

5. The relay according to claim 4, wherein at least part of the connection surface is overlapped with the one-end face in vertical projection of the relay onto the predetermined plane.

6. The relay according to claim 1, wherein the extended section having the specific relationship is extended along the moving direction.

7. The relay according to claim 1, wherein the extended direction of the extended section having the specific relationship is perpendicular to the moving direction and includes a component of a facing direction where the pair of fixed terminals face each other, and the extended section having the specific relationship is arranged to become closer to the movable contact, which is located on opposite side relative to the center section, from the movable contact located on same side relative to the center section to the center section with respect to the extended direction.

8. The relay according to claim 1, wherein the one-end face located on same side as the extended section having the specific relationship relative to the center section is formed in curved shape that is convex toward the second side.

9. The relay according claim 1, wherein the movable contact member is formed of a single member.

10. The relay according to claim 1, wherein the projecting part is configured to flow an electric current in the moving direction within the projecting part, thereby reducing an electromagnetic repulsion between the movable contact member and the fixed contact.

* * * * *